US011142930B2

(12) United States Patent
Strassburger et al.

(10) Patent No.: US 11,142,930 B2
(45) Date of Patent: Oct. 12, 2021

(54) EARRING SECURITY DISPLAY HANGER CONFIGURED TO SECURE DANGLE EARRINGS AND STUD EARRINGS

(71) Applicant: B&G Plastics, Inc., Union, NJ (US)

(72) Inventors: Jacob Strassburger, South Plainfield, NJ (US); Keith Cedro, Ho Ho Kus, NJ (US); Michael Norman, East Brunswick, NJ (US)

(73) Assignee: B&G Plastics, Inc., Union, NJ (US)

( * ) Notice: Subject to any disclaimer, the term of this patent is extended or adjusted under 35 U.S.C. 154(b) by 456 days.

(21) Appl. No.: 16/250,516

(22) Filed: Jan. 17, 2019

(65) Prior Publication Data

US 2019/0242159 A1 Aug. 8, 2019

Related U.S. Application Data

(60) Provisional application No. 62/625,589, filed on Feb. 2, 2018.

(51) Int. Cl.

| | |
|---|---|
| ***E05B 73/00*** | (2006.01) |
| ***B65D 73/00*** | (2006.01) |
| ***A47F 7/02*** | (2006.01) |
| ***A47F 5/00*** | (2006.01) |

(52) U.S. Cl.
CPC ..... *E05B 73/0017* (2013.01); *B65D 73/0064* (2013.01); *E05B 73/0005* (2013.01); *A47F 7/02* (2013.01); *B65D 2203/10* (2013.01); *B65D 2211/00* (2013.01)

(58) Field of Classification Search
CPC ..... E05B 73/0017; E05B 73/0005; B65D 73/0064; B65D 2211/00; B65D 2203/10; B65D 73/00; B65D 73/0071; A47F 7/02; A47F 7/024; A47F 5/0006; A47F 2010/005
USPC ..... 70/57, 57.1, 58, 61, 62; 206/1.5, 6.1, 206/566; 211/85.2; 248/551
See application file for complete search history.

(56) References Cited

U.S. PATENT DOCUMENTS

| | | | |
|---|---|---|---|
| 3,487,984 | A | 1/1970 | Loscalzo |
| 4,714,156 | A | 12/1987 | Kolton et al. |
| 4,765,467 | A | 8/1988 | Kolton et al. |
| 4,768,649 | A | 9/1988 | Kolton et al. |
| 4,930,692 | A | 6/1990 | Smilow et al. |
| 5,110,019 | A | 5/1992 | Kolton et al. |
| 5,123,577 | A | 6/1992 | Kolton et al. |

(Continued)

*Primary Examiner* — Lloyd A Gall
(74) *Attorney, Agent, or Firm* — Hoffmann & Baron, LLP

(57) ABSTRACT

An earring security display hanger includes a body member, first and second arms, and first and second closure members connected to the body member via the first and second arms. Each of the first and second closure members has a top wall and a side wall extending between the top wall and an open end such that a recess is formed therebetween. A closure member aperture is defined on the top wall of each of the closure members, and a plurality of first closure apertures and a plurality of second closure apertures are defined on the sidewall of the first and second closure members, respectively. A plurality of first closure hooks and a plurality of second closure hooks are formed from the body member and are configured to engage with the plurality of first closure apertures and the plurality of second closure apertures, respectively, to provide a locking mechanism.

19 Claims, 12 Drawing Sheets

(56) References Cited

U.S. PATENT DOCUMENTS

| | | | | |
|---|---|---|---|---|
| 5,215,700 | A | 6/1993 | Garganese | |
| 5,219,071 | A | 6/1993 | Knapp | |
| 5,222,638 | A | 6/1993 | Kolton et al. | |
| 5,328,065 | A | 7/1994 | Kolton et al. | |
| 5,501,378 | A | 3/1996 | Kolton et al. | |
| 5,582,387 | A | 12/1996 | Kolton et al. | |
| 5,615,810 | A | 4/1997 | Kolton et al. | |
| 5,664,669 | A | 9/1997 | VanFleet | |
| 5,826,760 | A | 10/1998 | Kolton et al. | |
| 5,988,462 | A | 11/1999 | Kolton | |
| 6,006,899 | A | 12/1999 | McAuley | |
| 6,073,758 | A | 6/2000 | Webster et al. | |
| 6,182,824 | B1 | 2/2001 | Kolton et al. | |
| 6,206,253 | B1 | 3/2001 | Kolton et al. | |
| 6,241,208 | B1 | 6/2001 | Lin | |
| 6,264,077 | B1 | 7/2001 | Kolton et al. | |
| 6,299,039 | B1 | 10/2001 | Hsu | |
| 6,425,482 | B1 | 7/2002 | Chiang | |
| 6,561,358 | B2 | 5/2003 | Kolton et al. | |
| 6,827,210 | B2 | 12/2004 | Chen | |
| 7,015,815 | B1 | 3/2006 | Feibelman | |
| 7,143,892 | B2 | 12/2006 | Kolton et al. | |
| 7,210,663 | B2 | 5/2007 | Wheeler | |
| 7,448,520 | B2 | 11/2008 | Kolton et al. | |
| 7,500,559 | B2 * | 3/2009 | Kim | B65D 73/0078 206/278 |
| 7,568,577 | B2 * | 8/2009 | Kim | B65D 85/18 206/278 |
| 7,588,144 | B2 * | 9/2009 | Kim | B65D 73/0078 206/278 |
| 8,286,882 | B2 | 10/2012 | Norman et al. | |
| 8,308,291 | B2 | 11/2012 | Norman et al. | |
| 8,337,016 | B2 | 12/2012 | Liebers | |
| 8,590,699 | B2 | 11/2013 | Feibelman | |
| 8,651,344 | B2 | 2/2014 | Norman et al. | |
| 8,833,116 | B1 | 9/2014 | Brown | |
| 9,301,625 | B2 * | 4/2016 | Fiumefreddo | A47F 7/16 |
| 9,480,347 | B2 | 11/2016 | Strassburger et al. | |
| 9,585,496 | B2 | 3/2017 | Strassburger et al. | |
| 9,975,682 | B2 | 5/2018 | Strassburger | |
| 10,413,095 | B2 | 9/2019 | Strassburger et al. | |
| 2002/0148746 | A1 | 10/2002 | Eriksson et al. | |
| 2004/0217249 | A1 | 11/2004 | Eisenbraun | |
| 2005/0056754 | A1 | 3/2005 | Salani | |
| 2005/0099303 | A1 | 5/2005 | Zuckerman | |
| 2006/0021889 | A1 | 2/2006 | Kim | |
| 2007/0001075 | A1 | 1/2007 | Niece | |
| 2012/0042702 | A1 | 2/2012 | Ezzo | |
| 2012/0043228 | A1 | 2/2012 | Ezzo et al. | |
| 2012/0255331 | A1 | 10/2012 | Markarian | |
| 2013/0015215 | A1 | 1/2013 | Coote | |
| 2014/0075725 | A1 | 3/2014 | Feibelman | |
| 2015/0102190 | A1 | 4/2015 | Fiumefreddo et al. | |
| 2015/0272364 | A1 | 10/2015 | Larsen | |
| 2015/0297011 | A1 | 10/2015 | Jones | |
| 2016/0058208 | A1 | 3/2016 | Strassburger | |
| 2016/0058209 | A1 | 3/2016 | Strassburger et al. | |
| 2017/0253408 | A1 | 9/2017 | Strassburger | |
| 2018/0087293 | A1 | 3/2018 | Strassburger et al. | |

* cited by examiner

EARRING SECURITY DISPLAY HANGER CONFIGURED TO SECURE DANGLE EARRINGS AND STUD EARRINGS

CROSS-REFERENCE TO RELATED APPLICATION

This application claims priority to U.S. Provisional Patent Application No. 62/625,589, filed on Feb. 2, 2018, the contents of which are incorporated herein by reference in its entirety.

FIELD OF THE INVENTION

The present invention relates to earring display hangers, and more particularly, to earring security display hangers with a theft deterrent locking mechanism, configured to accommodate and secure both dangle earrings and stud earrings.

BACKGROUND OF THE INVENTION

Earrings are commonly displayed for sale in retail stores on racks or in display cases where the earrings are hung. A variety of different hangers and tags have been used to secure small articles and to be suspended on a hook or the like, such as a pegboard hook for retail display. Because of earring's relative small size, it is hard to track each of them and can easily be stolen by consumers without security tags. These security tags can be enclosed in or attached to a variety of different devices, such as holder or housing, which accommodate the electronic tag and are used to attach the tags to article. However, these security tags present both manufacturing and assembling issues, which increase the cost and product complexity.

Accordingly, there is a need for an improved earring display hanger to prevent theft by consumers.

SUMMARY OF THE INVENTION

According to an embodiment of the present invention, an earring security display hanger includes a body member, first and second arms, and first and second closure members connected to the body member via the first and second arms. Each of the first and second closure members has a top wall and a side wall extending between the top wall and an open end such that a recess is formed therebetween. A closure member aperture is defined on the top wall of each of the closure members, and a plurality of first closure apertures and a plurality of second closure apertures are defined on the sidewall of the first and second closure members, respectively. A plurality of first closure hooks and a plurality of second closure hooks are formed from the body member and are configured to engage with the plurality of first closure apertures and the plurality of second closure apertures, respectively, to provide a locking mechanism.

These and other aspects of the present invention will be better understood in view of the drawings and following detailed description.

DETAILED DESCRIPTION OF PREFERRED EMBODIMENTS

Figure 1:
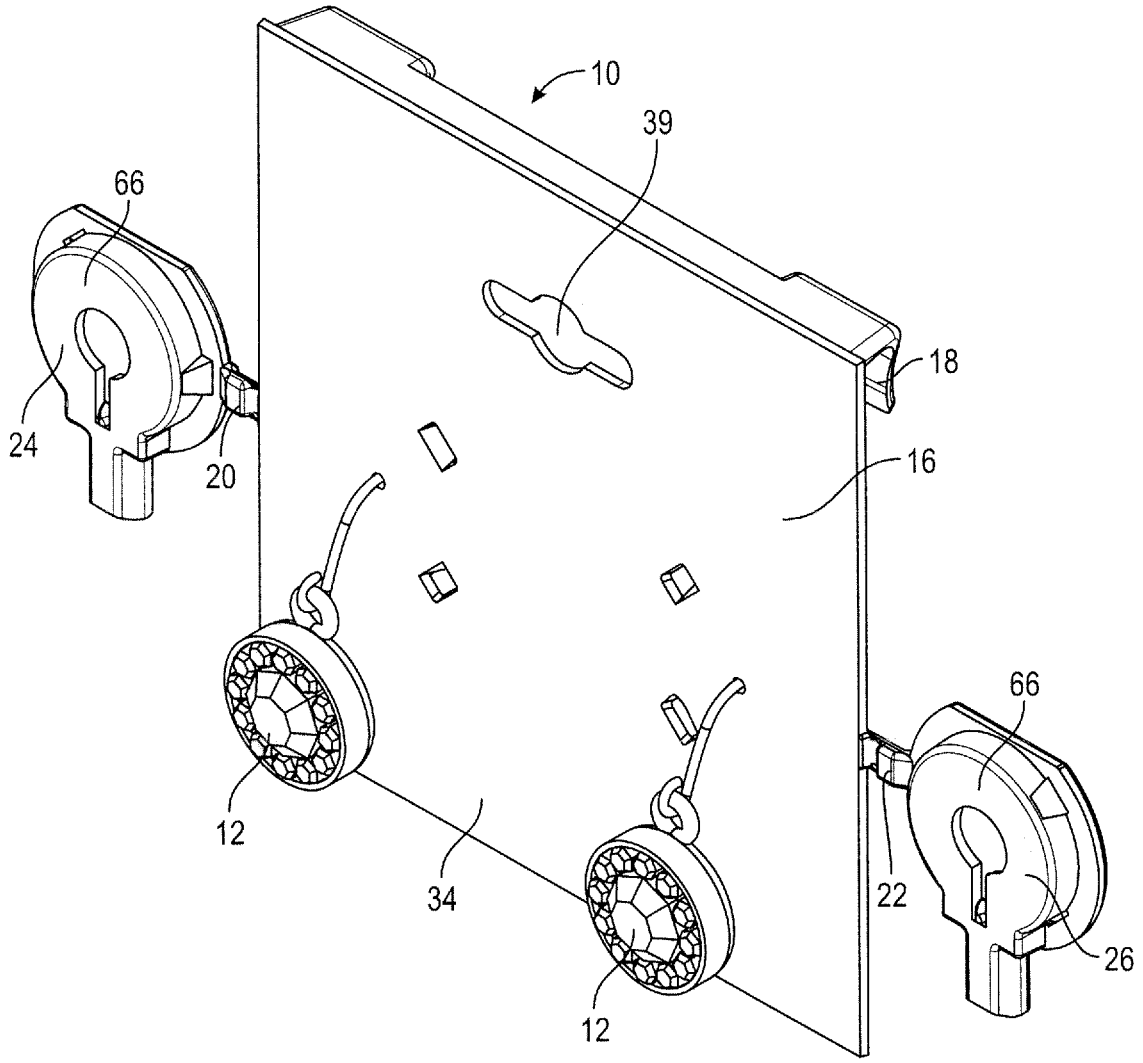
FIG. 1 is a perspective front view of the earring security display hanger, according to an embodiment of the present invention, with dangle earrings mounted thereon in an unlock/open position.
Figure 2:
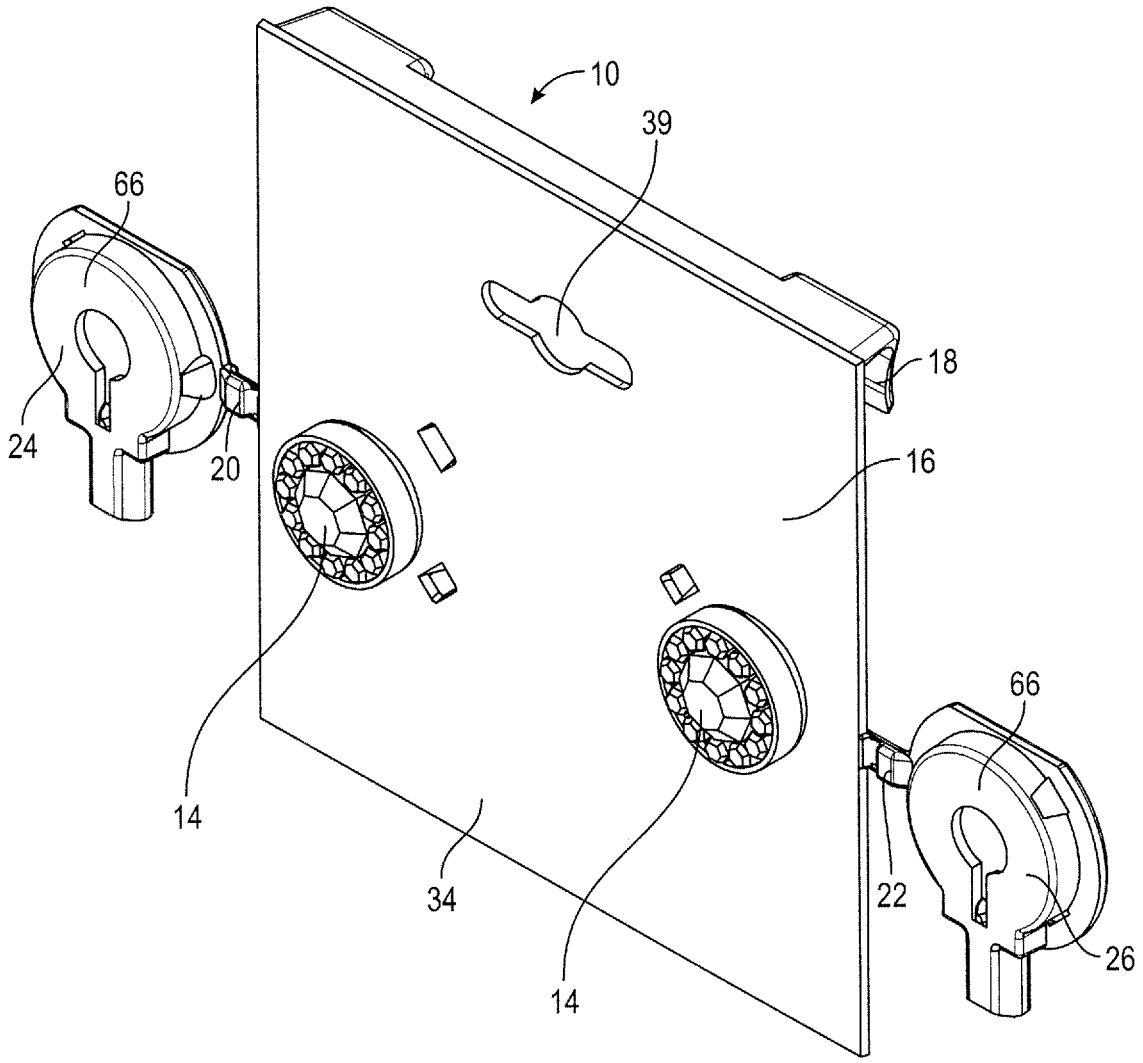
FIG. 2 is a perspective front view of the earring security display hanger in FIG. 1, with stud earrings mounted thereon.

According to an embodiment of the present invention, referring to FIGS. 1 and 2, there is shown an earring security display hanger 10 configured to accommodate and secure both dangle earrings 12 and stud earrings 14. The earring security display hanger 10 has a one-piece structure and includes a body member 16, a hook 18, first and second arms 20, 22, and first and second closure members 24, 26 connected to the body member 16 via the first and second arms 20, 22, respectively. The earring security display hanger 10 provides a locking mechanism such that the first and second closure members 24, 26 of the earring security display hanger 10 tightly secure the earrings 12, 14 to the earring security display hanger 10 to prevent theft by customers, as will be described in greater detail below.

Figure 3:
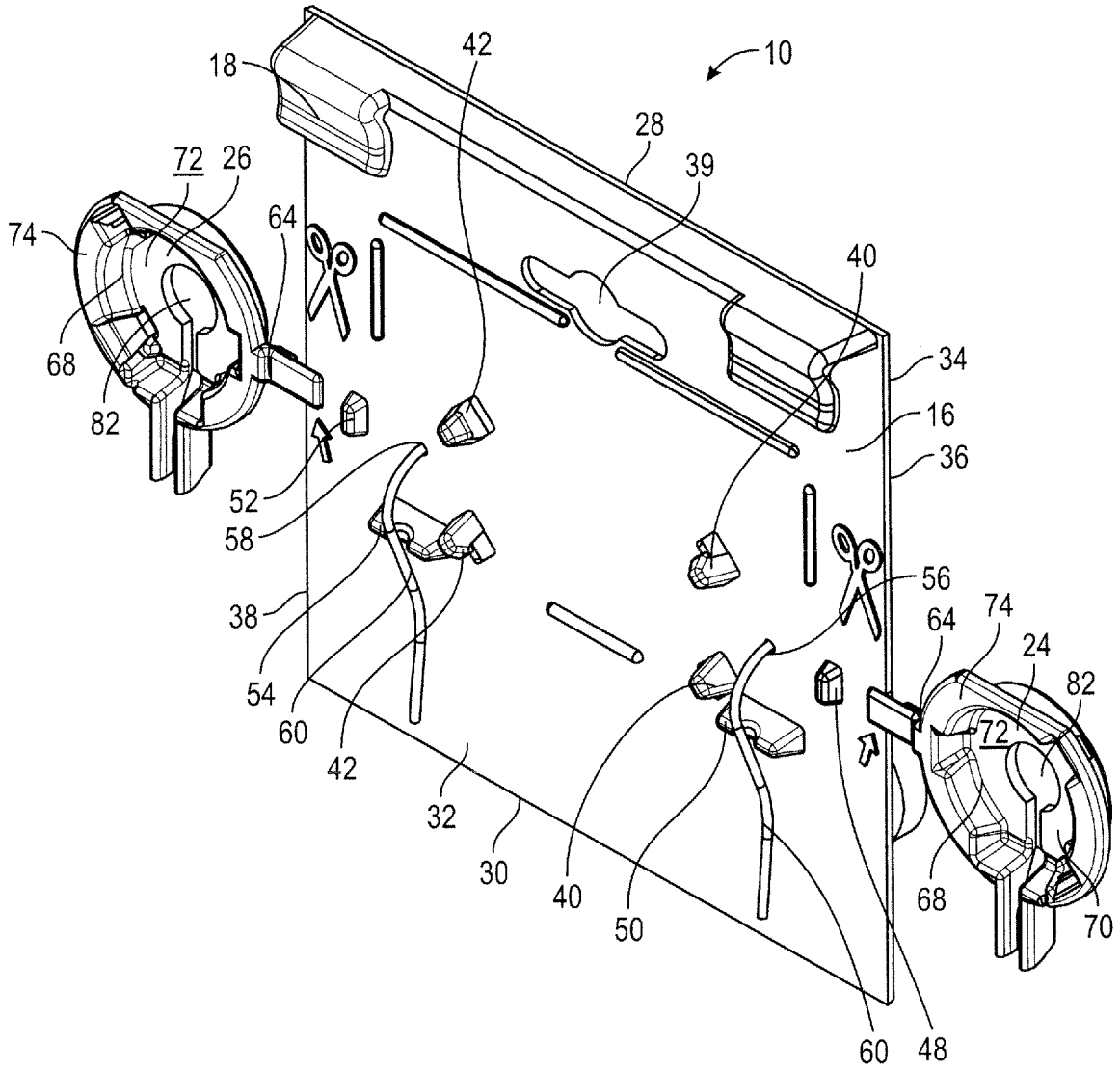
FIG. 3 is a perspective rear view of the earring security display hanger in FIG. 1.
Figure 4:
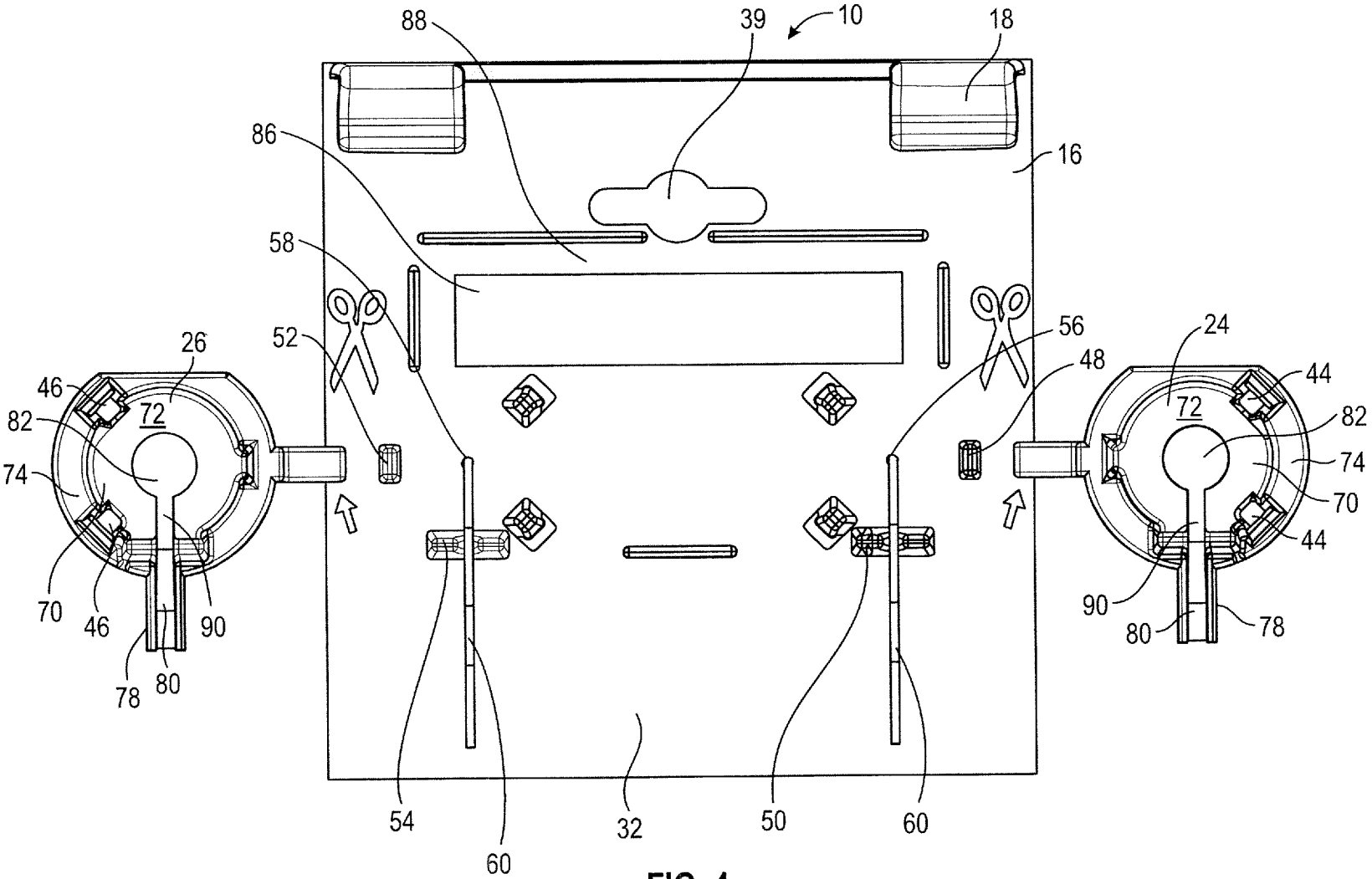
FIG. 4 is a rear view of the earring security display hanger in FIG. 1.

Referring to FIGS. 3 and 4, the body member 16 is generally flat and includes a first end 28, a second end 30, first and second sides 32, 34 extending from the first and second ends 28, 30, a first edge 36, and a second edge 38. The hook 18 is integrally attached to the top of the body member 16 to provide a means for mounting the earring security display hanger 10 on a display structure. A display aperture 39 is defined at the top of the body member 16 for engaging the earring security display hanger 10 with a display hook/rod for retail display. A plurality of first closure hooks 40 and a plurality of second closure hooks 42 are formed integrally from the first side 32 of the body member 16 and protrude outwardly therefrom. The plurality of first and second closure hooks 40, 42 are designed and configured to be inserted through a plurality of first and second closure apertures 44, 46 defined on the first and second closure members 24, 26, respectively, to provide a locking mechanism for securing the earrings 12, 14, as will be described in greater details below.

Figure 8:
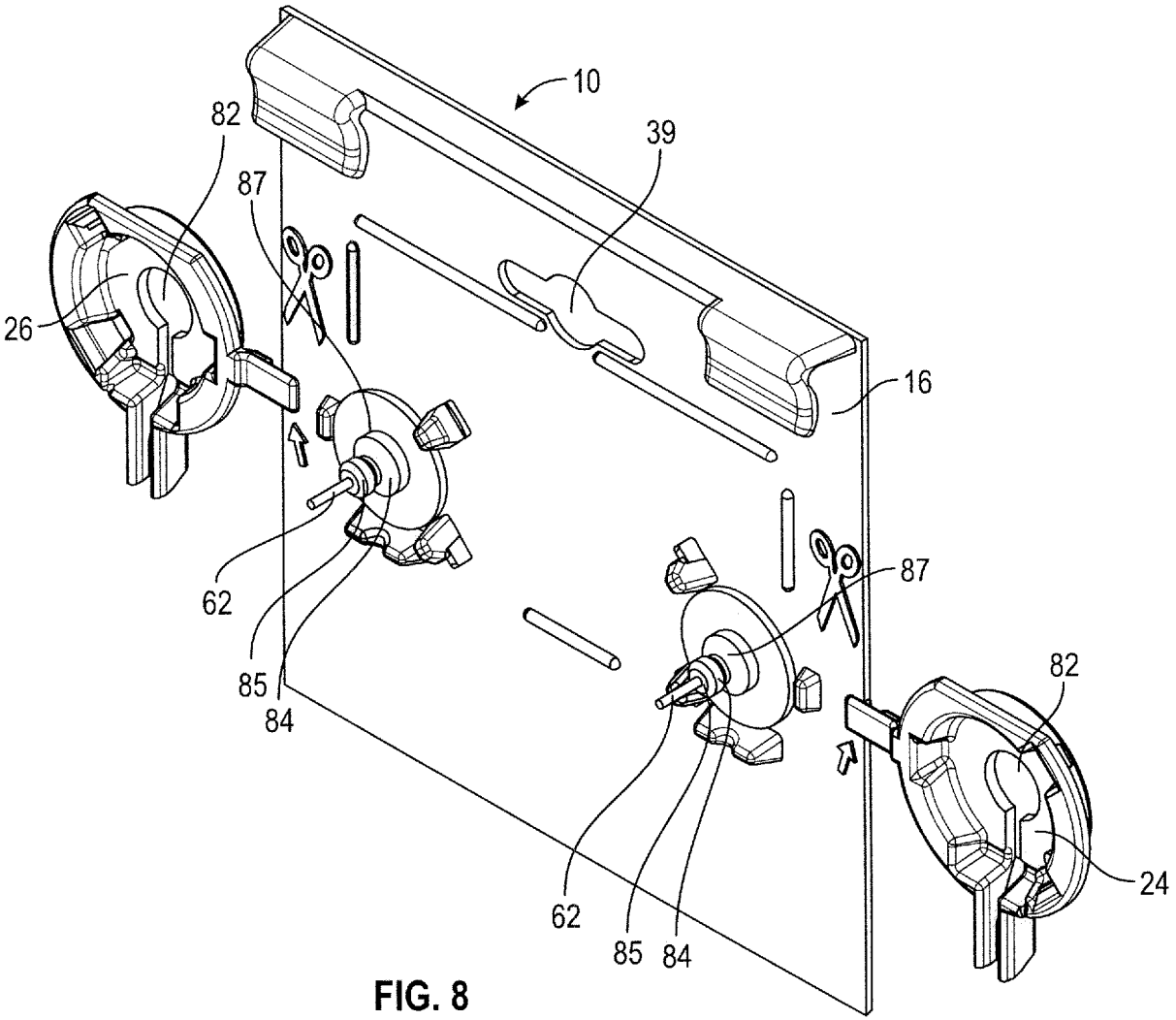
FIG. 8 is a perspective rear view of the earring security display hanger in FIG. 2.

A first side rib 48, a first bottom rib 50, a second side rib 52, and a second bottom rib 54 are also formed integrally from the first side 32 of the body member 16 and protrude outwardly therefrom. The first side rib 48 and the first bottom rib 50 are located in proximate to the plurality of first closure hooks 40, and the second side rib 52 and the second bottom rib 54 are located in proximate to the plurality of second closure hooks 42. The body member 16 further includes first and second earring holes 56, 58, through which an earring hook 60 of the dangle earring 12 or an earring post 62 of the stud earring 14 (FIGS. 8-10) can be inserted. The first and second earring holes 56, 58 are positioned such that the plurality of first closure hooks 40, first side rib 48, and first bottom rib 50 surround the first earring hole 56, and the plurality of second closure hooks 42, second side rib 52, and second bottom rib 54 surround the second earing hole 58, as shown in FIGS. 3 and 4.

Figure 5:
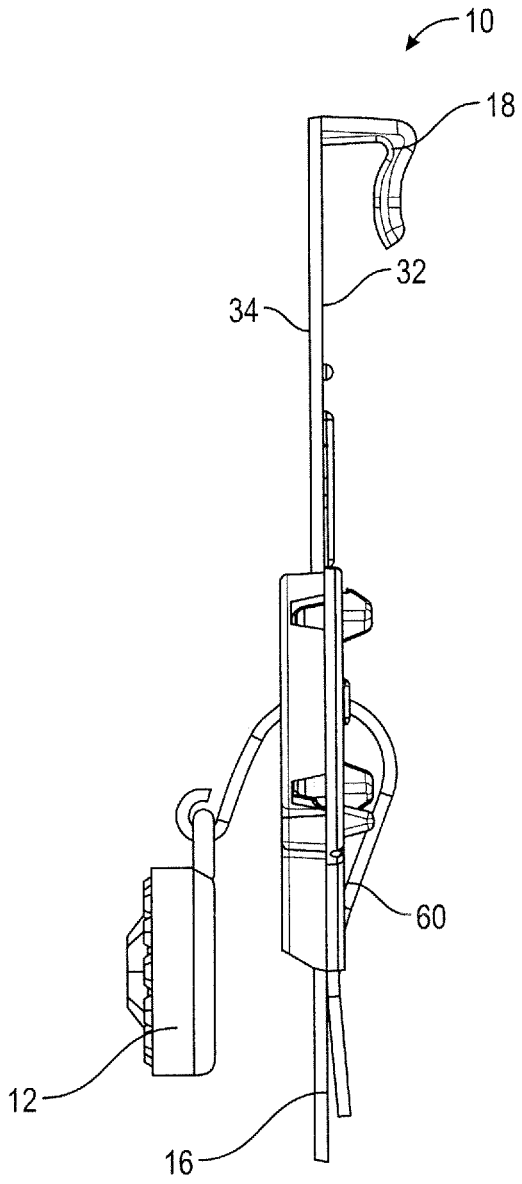
FIG. 5 is a side view of the earring security display hanger in FIG. 1.
Figure 6:
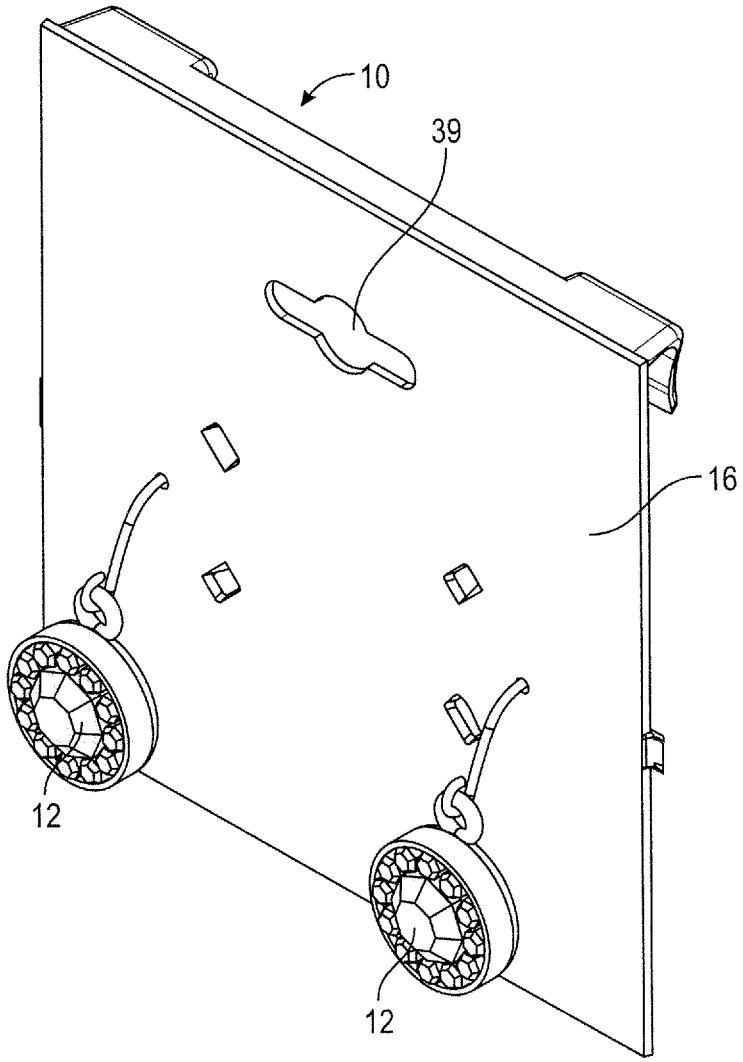
FIG. 6 is a perspective front view of the earring security display hanger in FIG. 1 in a locked/closed position.

Referring again to FIGS. 3 and 4, the first and second arms 20, 22 extend longitudinally approximately from the middle of the first and second edges 36, 38 of the body member 16, respectively, such that the arms 20, 22, side ribs 48, 52, and earring holes 56, 58 align horizontally. Each of the first and second arms 20, 22 includes a foldline 64, such as crease, to allow each of the first and second closure members 24, 26 to be folded along the foldline 64 to transition the earring security display hanger 10 between unlocked/open (FIGS. 1-5 and 8-10) and locked/closed positions (FIGS. 6, 7, 11, and 12). When the earring security display hanger 10 is fully assembled and is in the locked/closed position as shown in FIG. 5, the earrings 12, 14 can be displayed from the second side 34 of the body member 16.

Figure 12:
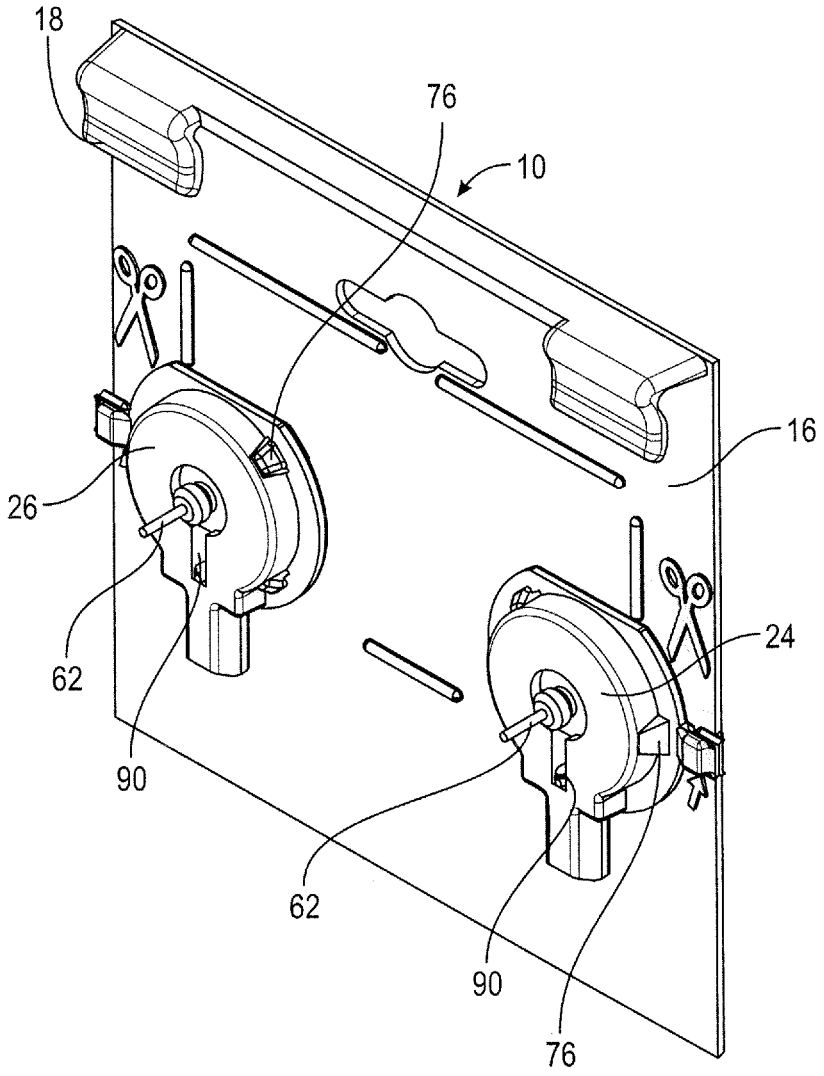
FIG. 12 is a perspective rear view of the earring security display hanger in FIG. 11.

Referring again to FIGS. 1-4, each of the first and second closure members 24, 26 has a generally round cross section and includes a top wall 66 and a sidewall 68 extending between the top wall 66 and an open end 70, defining a recess 72 therebetween. Each of the open ends 70 has a flange 74 formed thereabout, which engages with the first side 32 of the body member 16 when the earring security display hanger 10 transitions from the unlocked/open position to the locked/closed position. The plurality of first and second closure apertures 44, 46 are defined on the sidewall 68, through which the plurality of first and second closure hooks 40, 42 can be inserted, respectively. Specifically, contours of the plurality of first and second closure apertures 44, 46 and the plurality of first and second closure hooks 40, 42 are designed and configured such that, when engaged, they provide a locking mechanism, with a tip 76 of each of the plurality of first and second closure hooks 40, 42 protruding outwardly from the each corresponding closure aperture 44, 46 and engaging tightly with the flange 74, as illustrated in FIGS. 7 and 12.

To accommodate and secure the dangle earrings 12 to the earring security display hanger 10, a closure member channel 78 is integrally formed from the bottom of each of the first and second closure members 24, 26 and extends downwardly therefrom. The closure member channel 78 has a channel groove 80 such that, in the closed/locked position, a bottom portion of the earring hook 60 can be placed therewithin, as illustrated in FIG. 4. In addition, in the locked/closed position, the first and second bottoms ribs 50, 54 are disposed within the corresponding recess 72 immediately above the closure member channel 78.

Figure 7:
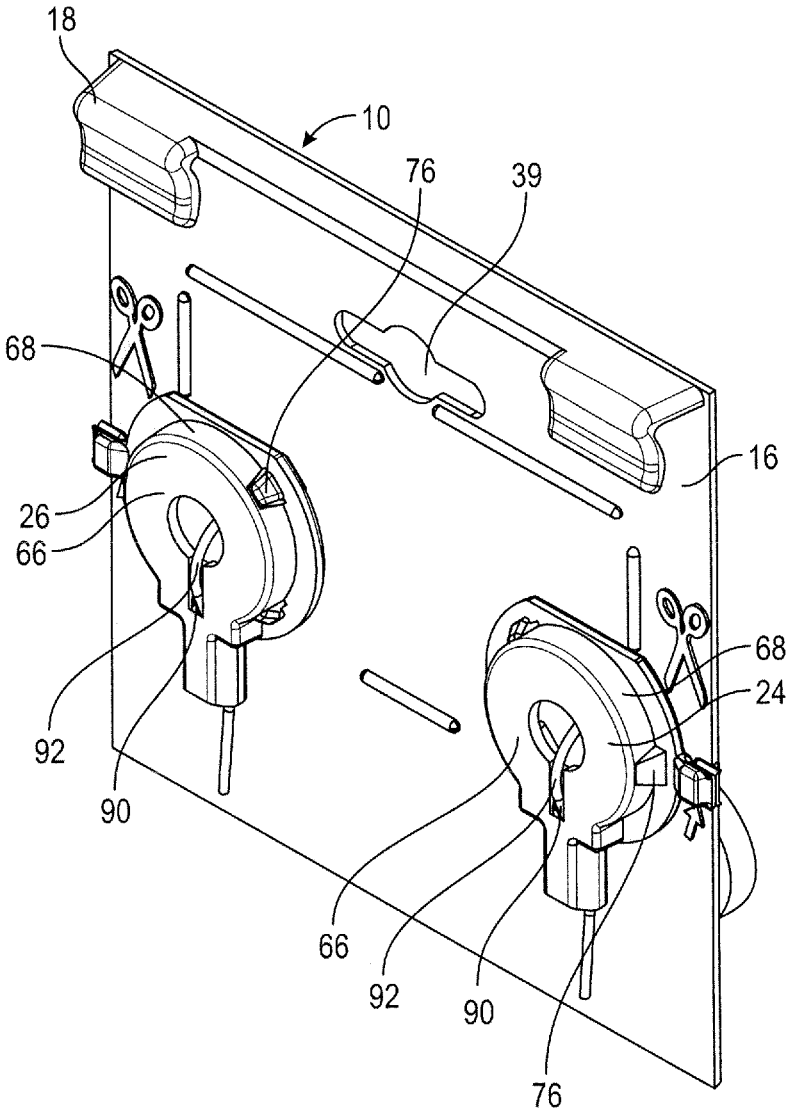
FIG. 7 is a perspective rear view of the earring security display hanger in FIG. 6.

Referring to FIGS. 4 and 7, each of the closure member apertures 82 has a vertical gap 90. When the earring security display hanger 10 is in the locked/closed position, the vertical gap 90 allows a curved portion 92 of the earring hook 60 to be protruded from the closure member 24, 26.

Referring to FIGS. 8-12, to accommodate and secure the stud earrings 14 to the earring security display hanger 10, a closure member aperture 82 is defined on the top wall 66 of each of the first and second closure members 24, 26. Specifically, once the earring posts 62 are inserted through the earring holes 56, 58 from the second side 34 of the body member 16, earring backs 84 of the stud earrings 14 can be inserted through the corresponding earing post 62 from the first side 32 of the body member 16. Then, the first and second closure members 24, 26 are folded to engage with the plurality of closure hooks 40, 42 such the earring posts 62 and top portions 85 of the earring backs 84 protrude outwardly through the closure member apertures 82, with bottom portions 87 of the earring backs 84 mounted against the first side 32 of the body member 16 and tightly secured within the closure members 24, 26. Thus, while the closure member apertures 82 allow the stud earrings 14 to easily be removed and reinserted into the earring holes 56, 58, the earring backs 84 cannot be removed from the closure members 24, 26.

Once the earring security display hanger 10 is in the locked/closed position, it is extremely difficult to open the first and second closure members 24, 26 with bare hands to separate the dangle earrings 12 or the earring backs 84 of the stud earrings 14 therefrom. In fact, the locked earring security display hanger 10 is not readily openable without destruction of the hanger 10. In addition, for the dangle earrings 12, since an inner surface of each of the first and second closure members 24, 26 presses a portion of the earring hook 60 against the corresponding side rib 48, 52 and the corresponding bottom rib 50, 54 to prevent from lifting and bending the earring hook 60, it is also difficult to pull and remove the dangle earrings 12 from the earring security display hanger 10. The earrings 12, 14 can be separated from the locked earring security display hanger 10 by cutting the first and second arms 20, 22 along the foldline 64.

Figure 9:
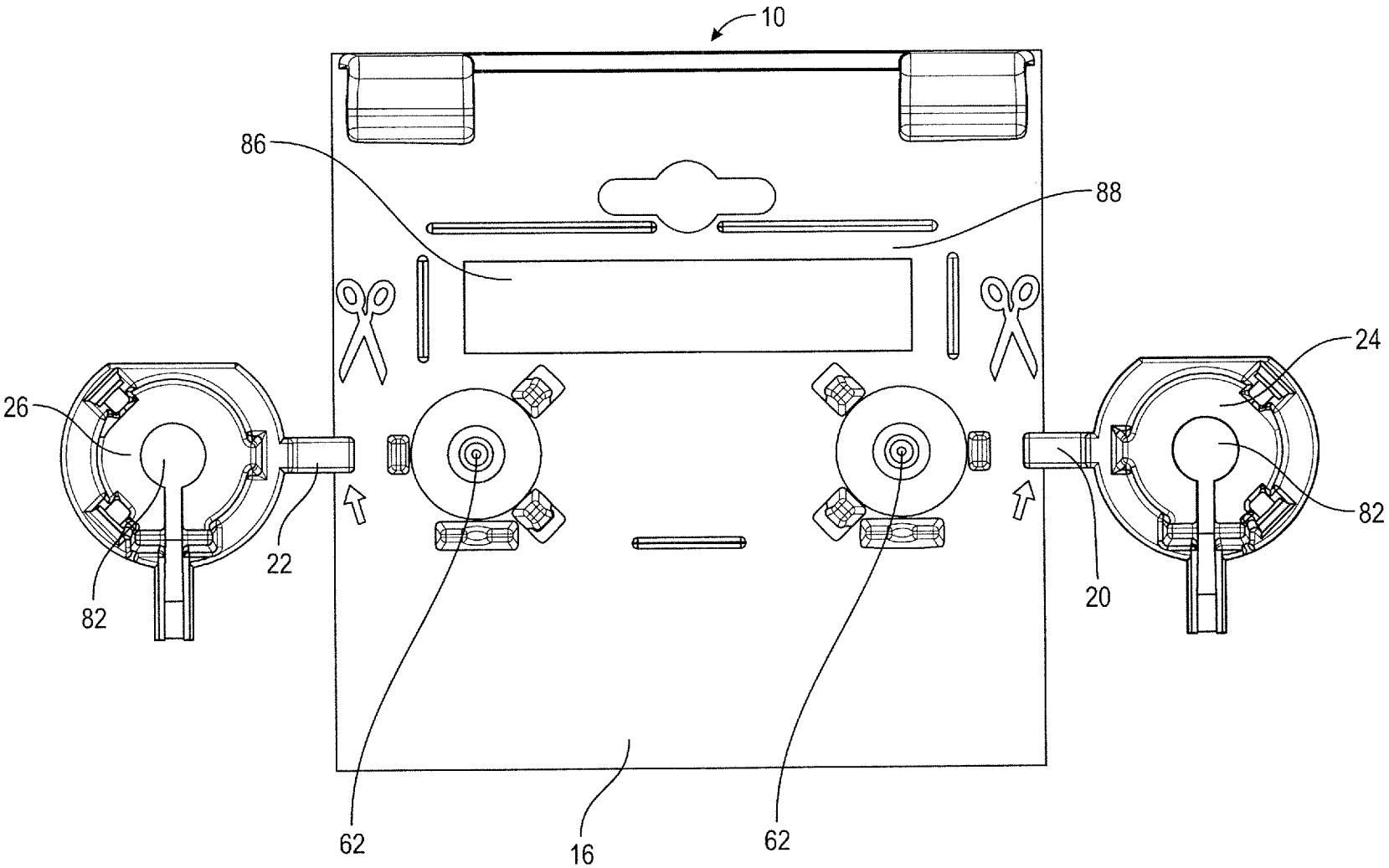
FIG. 9 is a rear view of the earring security display hanger in FIG. 2.
Figure 10:
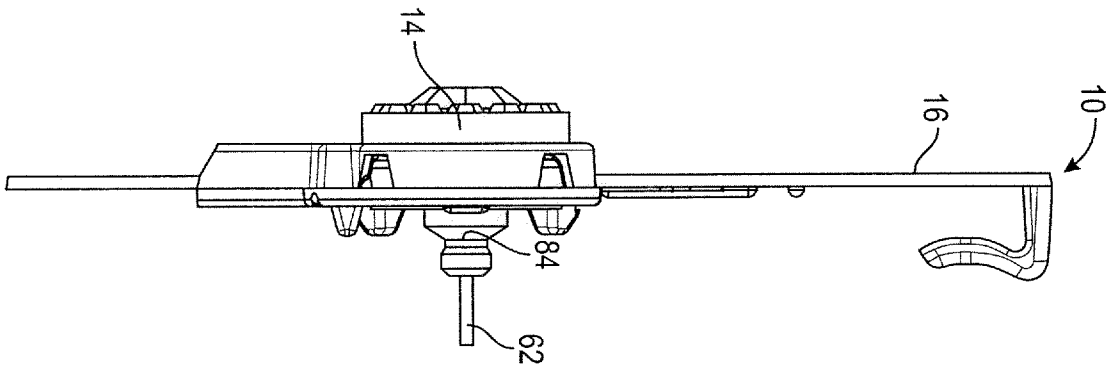
FIG. 10 is a side view of the earring security display hanger in FIG. 2.
Figure 11:
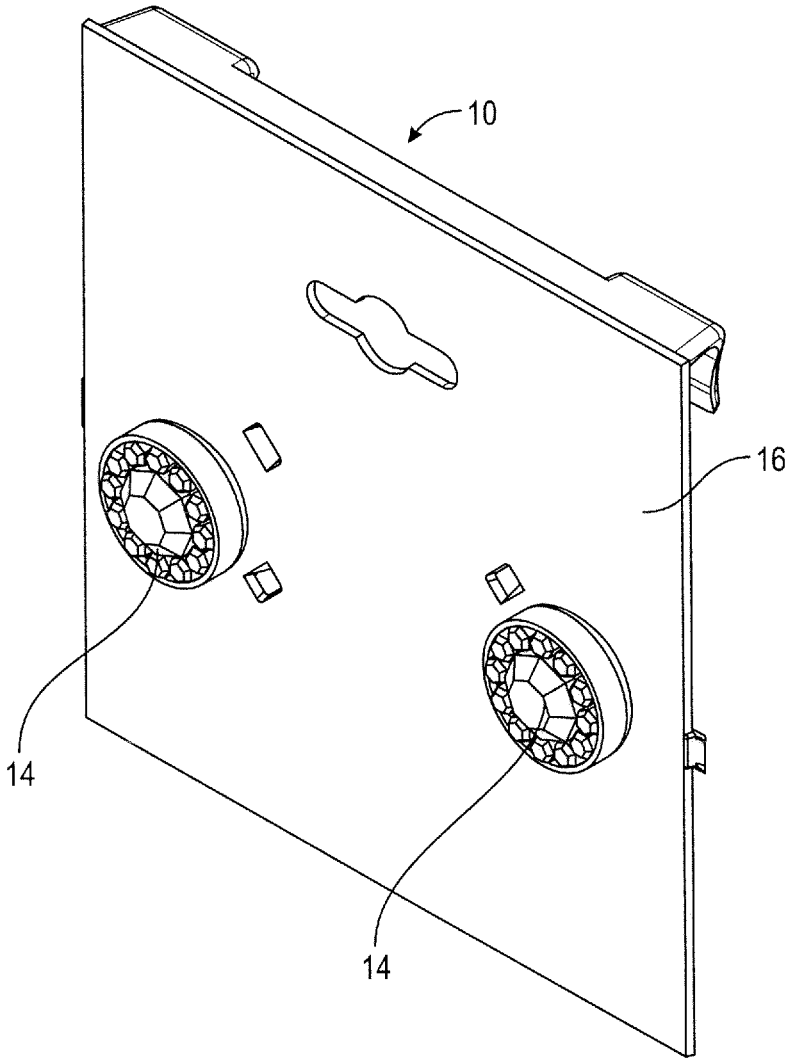
FIG. 11 is a perspective front view of the earring security display hanger in FIG. 2 in a locked/closed position.

Referring to more particularly FIGS. 4 and 9, a security tag 86, e.g., a radio frequency identification (RFID) tag or the like, may be applied to a tag portion 88 defined on the first side 32 of the body member 16. Alternately, the security tag 86 could be applied on the second side 34 of the body member 16. The security tag 86 may be applied in any fashion and may even be concealed on the body member 16. In addition to the security tag 86, other pictures such as logos or text (including product descriptions) may be printed on, embossed in, or otherwise attached to the first or/and second side(s) 32, 34 of the body member 16.

The security tag 86 attached to the earring security display hanger 10 has a wide variety of uses, including tracking, inventory control, and security. The security tag 86 can also provide electronically readable information pertaining to the earrings 12, 14. The security tag 86 is a radio frequency identification (RFID) tag, an electronic article surveillance (EAS) device or the like. The security tag 86 is firmly secured to the earring security display hanger 10 such that it remains with the earrings 12, 14 until after the time of purchase.

The earring security display hanger 10 is made out of one or more materials having suitable properties for a desired application, including strength, weight, rigidity, etc. Plastic is generally preferred. It will be appreciated that other designs and configurations, such as a square cross section, could be used for the first and second closure members 24, 26, as deemed suitable for given application factors.

In use of the earring security display hanger 10, first, in the unlocked/open position, the earrings 12, 14 are placed to the second side 34 of the body member 16 by inserting the earring hooks 60 or earring posts 62 through the first and second earring holes 56, 58. For the stud earrings 14, the earring backs 84 are inserted through the earring posts 62 from the first side 32 of the body member 16. Then, by folding the first and second arms 20, 22 and first and second closure members 24, 26 along the foldlines 64, and locking the first and second closure members 24, 26 by engaging each of the plurality of closure hooks 40, 42 with the corresponding closure aperture 44, 46, the earring security display hanger 10 is ready for suspension on a display hook or the like, such as a pegboard hook for retail display. Once a consumer purchases the earrings 12, 14, the consumer can remove them from the earring security display hanger 10 by cutting the first and second arms 20, 22 along the foldlines 64.

From the foregoing, it will be appreciated that an earring security display hanger according to the present invention may be used for anti-theft, tracking and inventory control, while providing the design that is convenient for merchants to display their goods.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. An earring security display hanger comprising:

a generally flat body member having a first end, a second end, first and second sides extending from the first and second ends, a first edge, and a second edge;

first and second arms extending longitudinally from the first and second edges of the body member, respectively; and first and second closure members connected to the body member via the first and second arms, respectively, each of the first and second closure members having a top wall and a sidewall extending between the top wall and an open end such that a recess is formed therebetween, wherein a closure member aperture is defined on the top wall of each of the first and second closure members, and a plurality of first closure apertures and a plurality of second closure apertures are defined on the sidewall of the first and second closure members, respectively, wherein a plurality of first closure hooks and a plurality of second closure hooks are formed from the first side of the body member and are configured to engage with the plurality of first closure apertures and the plurality of second closure apertures, respectively, to provide a locking mechanism.

2. The earring security display hanger of claim 1, wherein the earring security display hanger is configured to accommodate and secure dangle earrings and stud earrings.

3. The earring security display hanger of claim 1, wherein each of the first and second arms includes a foldline to allow each of the first and second closure members to be folded along the foldline to transition the earring security display hanger between unlocked/open and locked/closed positions.

4. The earring security display hanger of claim 1, wherein the open end of each of the first and second closure members has a flange formed thereabout.

5. The earring security display hanger of claim 4, wherein contours of the plurality of first and second closure apertures and the plurality of first and second closure hooks are designed and configured such that, when engaged, a tip of each of the plurality of first and second closure hooks protrudes outwardly from the each corresponding closure aperture and engages tightly with the flange.

6. The earring security display hanger of claim 1, wherein the body member has first and second earring holes, through which an earring hook of a dangle earring or an earring post of a stud earring can be inserted.

7. The earring security display hanger of claim 6, wherein a first side rib, a first bottom rib, a second side rib, and a second bottom rib are formed from the first side of the body member and protrude outwardly therefrom.

8. The earring security display hanger of claim 7, wherein the first and second earring holes are positioned such that the plurality of first closure hooks, first side rib, and first bottom rib surround the first earring hole, and the plurality of second closure hooks, second side rib, and second bottom rib surround the second earing hole.

9. The earring security display hanger of claim 7, wherein a closure channel is formed from the bottom of each of the first and second closure members and extends downwardly therefrom.

10. The earring security display hanger of claim 9, wherein the closure channel has a channel groove such that, in the locked/closed position, a bottom portion of an earring hook of a dangle earring can be placed therewithin.

11. The earring security display hanger of claim 9, wherein, in the locked/closed position, the first and second bottoms ribs are disposed within the recess immediately above the closure member channel of the first closure member and the second closure member, respectively.

12. The earring security display hanger of claim 6, wherein, in the locked/closed position, an earring back of the stud earring is tightly secured within the recess with the earring post protruding through the closure member aperture, allowing the stud earring to be easily removed and reinserted into the earring hole.

13. The earring security display hanger of claim 1, wherein the body member includes a hook on the first end to provide a means for mounting the earring security display hanger on a display structure.

14. The earring security display hanger of claim 6, wherein, in the closed/locked position, an inner surface of each of the first and second closure members presses a portion of the earring hook against a corresponding rib to prevent from lifting and bending the earring hook.

15. The earring security display hanger of claim 6, wherein the closure member aperture has a vertical gap, such that, when the earring security display hanger is in the locked/closed position, the vertical gap allows a curved portion of the earring hook to be protruded from the closure member.

16. The earring security display hanger of claim 1, further comprising a security tag.

17. The earring security display hanger of claim 16, wherein the security tag is used for tracking, inventory control and security.

18. The earring security display hanger of claim 16, wherein the security tag is a radio frequency identification (RFID) tag or an electronic article surveillance (EAS) device.

19. The earring security display hanger of claim 16, wherein a tag portion is defined on the first side of the body member for accommodating the security tag therewithin.

* * * * *